United States Patent [19]

Frank

[11] 4,421,290

[45] Dec. 20, 1983

[54] SUPPORT LEG FOR MOBILE CONVEYORS

[76] Inventor: Xaver Frank, Reuthe 86 ½, Lengenwang 8951, Fed. Rep. of Germany

[21] Appl. No.: 255,464

[22] Filed: Apr. 20, 1981

[30] Foreign Application Priority Data

Apr. 25, 1980 [DE] Fed. Rep. of Germany ..... 3016035
Dec. 4, 1980 [DE] Fed. Rep. of Germany ... 8032342[U]

[51] Int. Cl.[3] ..... F16M 13/00
[52] U.S. Cl. ..... 248/558; 248/632
[58] Field of Search ..... 248/558, 632, 615, 580; 280/763

[56] References Cited

U.S. PATENT DOCUMENTS

| | | | |
|---|---|---|---|
| 1,917,644 | 7/1933 | Guy | 248/632 |
| 1,973,226 | 9/1934 | Rose et al. | 182/109 |
| 2,549,768 | 4/1951 | Bradley | 248/632 X |
| 3,219,362 | 11/1965 | Epstein | 280/763 |
| 3,930,668 | 1/1976 | Schuermann | 280/763 |

FOREIGN PATENT DOCUMENTS

| | | | |
|---|---|---|---|
| 1238167 | 4/1967 | Fed. Rep. of Germany . | |
| 2907850 | 1/1980 | Fed. Rep. of Germany | 248/558 |
| 1147909 | 4/1969 | United Kingdom | 248/615 |

*Primary Examiner*—J. Franklin Foss
*Assistant Examiner*—Sarah A. Lechok
*Attorney, Agent, or Firm*—Lerner, David, Littenberg, Krumholz & Mentlik

[57] ABSTRACT

A leg support is disclosed for supporting a device such as a mobile conveyor or the like which is subject to vibration and movement. The leg support includes a substantially flat lower support shoe, a block of elastomeric material at least one face of which includes substantially uniform treads, such as parallel grooves thereon, and whose other face is adapted for contacting the lower support shoe so that the block of elastomeric material can adapt to variations in the surface on which the device is resting, and a support for detachably maintaining the elastomeric block in a predetermined position in contact with the lower support shoe.

18 Claims, 9 Drawing Figures

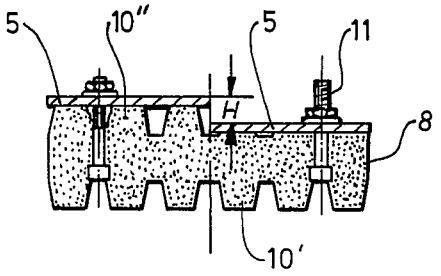
Fig. 4
Fig. 5
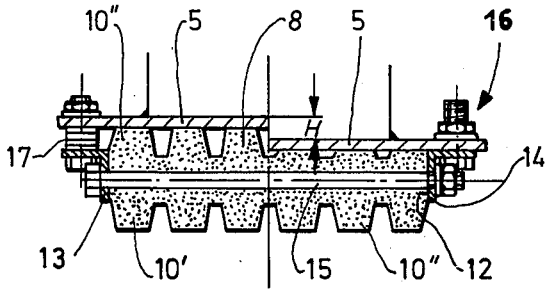
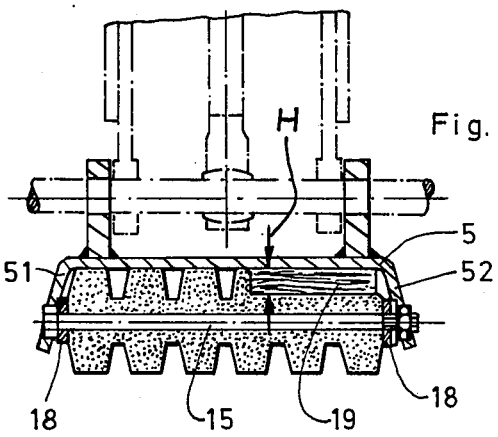
Fig. 6
Fig. 7
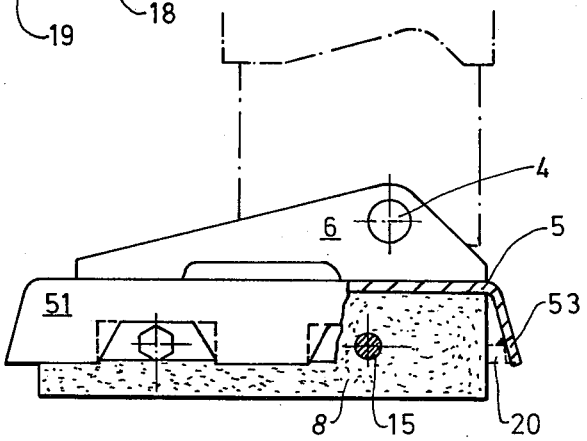

SUPPORT LEG FOR MOBILE CONVEYORS

FIELD OF THE INVENTION

The present invention relates to leg supports. More particularly, the present invention relates to leg supports for supporting mobile conveyors and the like. Still more particularly, the present invention relates to leg supports for supporting various devices which are subject to vibration and movement and for displacing the forces created thereby.

BACKGROUND OF THE INVENTION

Leg supports for supporting mobile conveyors and the like are known which include a smooth elastic rubber sole which is evenly attached to the bottom side of a support shoe so that the sole is smooth and cannot adapt itself to the ground or surface on which it is resting in an acceptable manner. Therefore it does not adhere to the ground sufficiently, and this insufficient adaptability of the sole results in a highly changeable strain on the elastic material, particularly when a moving weight is involved and there is a resultant change in the support reaction on the leg support itself. In order to protect the sole from over-straining and to give it more support, such supports have been designed so that the elastic rubber sole is solidly attached to the leg support such as by vulcanizing it to the leg support. The disadvantages of this, however, are that the entire leg support has to be replaced after the sole has worn down.

It is therefore an object of the present invention to create a leg support which securely adheres to any ground and which has an extremely long life span, and furthermore which has a simple constructive arrangement and ensures economical operation.

SUMMARY OF THE INVENTION

In accordance with the present invention these and other objects have now been met by means of a leg support for such devices which are subject to vibration and movement, such as mobile excavators, rear loaders, or similar commercial vehicles in stationary applications, in which the leg support includes a substantially flat lower support shoe. The leg support includes a sole member comprising a block of elastomeric material, such as rubber, including first and second parallel faces, the first face being adapted to contact the lower support shoe face of the leg and the second face including substantially uniform treads thereon, whereby when the device is supported on a surface with the second face of the sole member in contact with that surface, the sole member can adapt to variations in the surface on which it is resting, as well as to vibrations and movement of the device itself, and support means for detachably maintaining the sole member in a predetermined position in contact with the lower support shoe.

By constructing the leg support as a treaded monoblock the sole itself is permitted to adapt to uneven ground under elastic displacement of the grooves forming the treads, and to take up the weight applied thereto over the entire block. Adherence will be greatly improved in that manner, and the stresses on the sole are maintained so uniform in connection with changes in weight that the appearance of fatigue in the sole itself is practically eliminated. Since the load reaction force is equally transmitted to the sole in this manner it does not have to be bonded to the leg support as in the past, i.e., it is now sufficient that it merely rest upon it. The force transfer to the sole is therefore relatively free from compulsive forces, and the sole can be easily changed upon the appearance of a specified wear without having to change the entire leg support. The bracing of these treaded blocks with the leg support stabilizes the monoblock and places it under a predetermined amount of pressure which prevents eventual local appearance of tensile strains from over-stressing the material forming the monoblock. The life span of the block is therefore additionally increased.

In accordance with a preferred embodiment of the present invention the substantially uniform treads across the faces of the block of elastomeric material comprises a plurality of parallel grooves across those faces. Preferably the support means comprises a support plate including at least one pair of parallel side wall members depending from the lower support shoe so as to encompass the sole member between those side wall members.

In a preferred embodiment of the present invention both the first and second faces of the sole member include substantially uniform treads, such as the parallel grooves set forth above, whereby the detachable sole member is reversible, with either the first or second face thereof coming into contact with the lower support shoe of the leg. This embodiment has an additional advantage in that the life span of the sole, and thus the application cycle of the leg support, is increased. The reason for this is that the monoblock can be used again, after it is worn on one side in the same basic application.

This reversible unit thus supports itself on the lower support shoe with those treads which are parallel and opposite to the treads resting on the bottom surface on which the device is resting. In this manner the monoblock is formed as a reversible body and is attached on its sides in a holding plate on the leg support. The monoblock does not project over the side wall members with its unused treads after the worn side of the treads has been reversed.

In accordance with another embodiment of the present invention, the parallel grooves on the surface of the sole member include a base portion, and the support means include support flange means projecting from the lower support shoe, these support flange means having a pattern which corresponds to the grooves in the sole member so that the support flange means contact the base portion of the grooves when the sole member is in contact with the lower support shoe.

In accordance with another embodiment of the present invention the support means includes support bolt means including a first end and a second end, the first end of the support bolt means being adjustably affixed to the lower support shoe and the second end of the support bolt means embedded in the sole member.

In accordance with another embodiment of the present invention the support means includes clamping bolt means extending through the sole member substantially parallel to the lower support shoe, and embedded in the sole member, the clamping bolt means being mounted at its ends on the at least one pair of parallel side wall members. These clamping or tightening bolts give additional support to the monoblock with the simplest type of assembly thereby increasing the rigidity thereof without affecting its adherence characteristics.

Preferably, sleeve means are embedded and extend through the sole member substantially parallel to the lower support shoe so that the clamping bolt means can be contained within those sleeve means. Preferably these sleeves are steel sleeves, which are vulcanized into the rubber sole member. In this embodiment, the stiffening effect is reinforced and the monoblock is not subjected to excessive stress thereby.

In accordance with another embodiment of the present invention the at least one pair of parallel side wall means adjustably depend from the lower support shoe so that the distance between the clamping bolts and the lower support shoe can be adjusted.

In accordance with the preferred embodiment of the present invention L-shaped angle means are provided so that one leg of the L-shaped angle means comprise the side wall members and the other leg of the L-shaped angle means are parallel and adjacent to the lower support shoe, and screw means are provided for adjustably connecting that other leg of the L-shaped angle means to the lower support shoe.

In another embodiment of the present invention the at least one pair of parallel side wall members comprises an extension of the lower support shoe formed by bends therealong. Preferably the support plate includes two pairs of parallel side wall members thereby completely surrounding the sole member.

In accordance with another embodiment of the present invention the support means includes at least one pair of parallel holding plates welded to the lower support shoe in order to encompass the sole member between the holding plates.

In accordance with the preferred embodiment of the present invention the sole member has a shore hardness of between about 70 and 80.

In accordance with another embodiment of the present invention the substantially uniform treads include a plurality of second parallel grooves across the second face of the sole member substantially perpendicular to the first set of parallel grooves thereacross, so as to form a grid thereon. Preferably, the substantially uniform treads on the sole member are formed by a plurality of tread members having the cross-sectional shape of a truncated pyramid. Preferably these truncated pyramids have side walls with a slope of between about 6° and 8°, and the grooves themselves have a height of about 25 mm.

BRIEF DESCRIPTION OF THE DRAWINGS

The present invention may be more fully understood with reference to the following drawings wherein;

FIG. 4 is a partial, sectional, representational view of another embodiment of the leg support of the present invention;

FIG. 5 is a partial, sectional, representational view of another embodiment of the leg support of the present invention;

FIG. 6 is a partial, sectional, partially phantom view of another embodiment of the leg support of the present invention;

FIG. 7 is a partial, sectional, side, partially phantom view of the leg support shown in FIG. 6;

DETAILED DESCRIPTION

Figure 1:
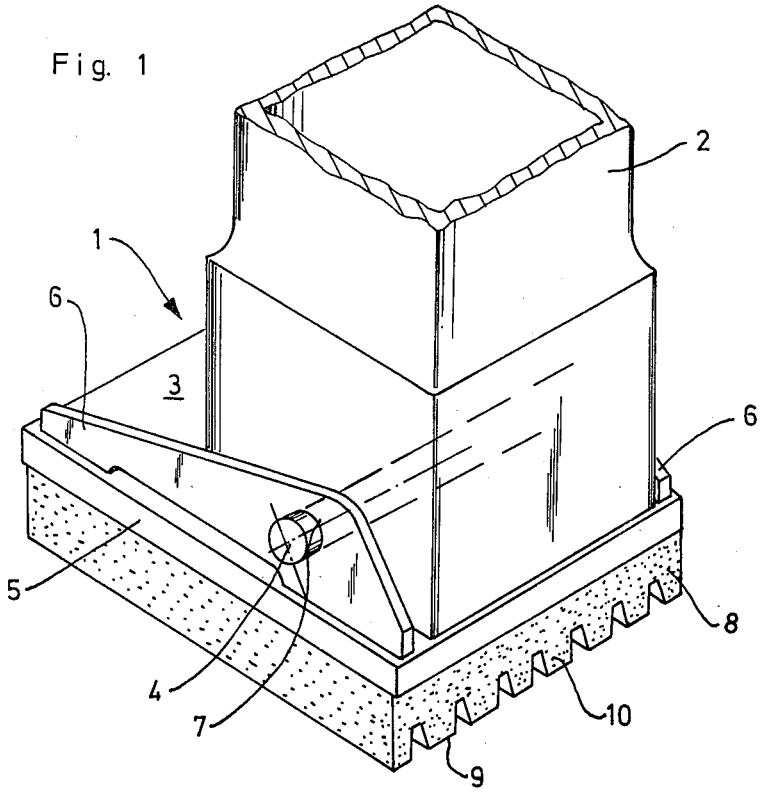
FIG. 1 is a partial, sectional, elevated, side view of the leg support of the present invention in conjunction with a portion of a leg.

Referring to the figures, in which like numerals refer to like portions thereof, FIG. 1 shows the bottom portion of a leg support 1 in which a support shoe 3 is connected through a flush swivel joint to its support strut 2. The support shoe 3 according to this design is constructed by a support plate 5, and on its top side are welded two parallel holding plates 6, each of which is provided with an aligned hole 7.

Figure 2:
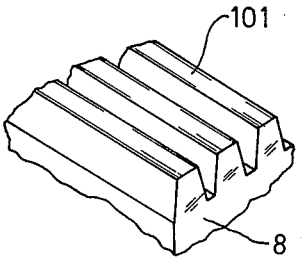
FIG. 2 is a partial, elevational, view of a portion of the surface of the sole member of the leg support of the present invention.
Figure 3:
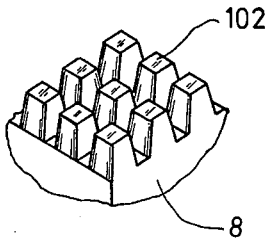
FIG. 3 is a partial, elevational view of the surface of another embodiment of the sole member of the leg support of the present invention.

On the lower surface of support plate 5 a square formed sole 8 made of elastic rubber material is attached. This sole consists of at least a self-supporting monoblock of which the bottom, i.e., the base 9 of the sole, includes treads so that the grooves 10 are formed such that they can adapt themselves to the ground. The grooves 10 are evenly cut, and as can be seen in FIGS. 2 and 3, take on different forms. In FIG. 2 grooves 101 are shown which are in the form of parallel tunnels running over the entire width of sole 8. In FIG. 3, however, grooves 102 are shown which are in the form of truncated pyramids. The taper of these grooves influences the adherence of dirt to the sole 8. Preferably it should be between about 6° and 8°, and preferably the height of the tread should be about 25 mm.

The material from which the sole is formed should have a shore hardness of between about 70 and 80 in order to maintain the life span sufficiently long. The preferred material for use is rubber or web reinforced rubber as is used in the manufacture of tires. Discarded truck tires can also be used, which are preferably prepared accodingly, i.e., by machining.

The attachment of the sole 8, i.e., of the monoblocks, can be accomplished in a number of ways, but always so that their reverse side rests on support plate 5. In the form shown in FIG. 1, this attachment is achieved through several fastening studs which are sunk or embedded in the monoblock and screwed together with supporting plate 5. In the design shown in FIG. 4 the monoblock 8 has on both parallel sides a tread with grooves 10′ and 10″, so that it can be formed as a reversible sole. The attachment of the monoblock is thus achieved through fastening bolts 11 which are screwed together with the support plate 5, or through a single bolt-nut connection. The left side of the illustration in FIG. 4 shows the sole 8 in the first application cycle, and the right side shows the already reversed sole 8 therein. In this embodiment one tread profile is shown as already worn down, and in this case is tightened against the support plate 5.

Referring to FIG. 5, another design form of the leg support of this invention is shown in which another reversible sole is employed. Again in this case the left side of the illustration shows attachment of the unused side, while the right side shows attachment of the worn side of monoblock 8 thereto. In this design monoblock 8 is not tightened from the bottom, but is tightened from the side. For this purpose, on two opposing side surfaces 12 of monoblock 8 are tightening plates 13 and 14 which enclose the monoblock, whereby the tread on the bottom side 9 of monoblock 8 is exposed therebelow. Because a number of clamping bolts 15 can extend through the middle of the monoblock 8, the monoblock can then be tightened with the clamping plates. Clamping plates 13 and 14 are constructed as angle pieces, and are tightly connected by a screw connection 16 to support plate 5. In order to compensate for the wear height H of the tread 10' a spacer pack 17 can be eliminated from between the angle pieces 13 and 14 and the support plate 5. The spacer pack 17 can be replaced by a single bushing.

Referring to FIGS. 6 and 7, an additional possible construction of the support shoe is shown. In this case the clamping plates 13 and 14 in FIG. 4 are formed from bends 51 and/or 52 on the support plate 5. Attachment of the monoblock is thus achieved by similar means to those shown in FIG. 5. Again referring to FIG. 6, the left side shows the full tread on both sides of the monoblock while the right side shows one tread having been worn down. In this case, clamping bolt 15 extends through clamping plates 51 and 52, as well as through monoblock 8. So as not to weaken the bend because of the small bending radians, straps 18 are welded to clamping plates 51 and 52 which lie against monoblock 8. The wear height H shown on the right side of FIG. 6 includes a spacing plate 19 made of wood, metal or plastic, which is inserted in place of the worn treads.

Referring to FIG. 7, an enclosure of the monoblock 8 is shown which can be achieved on all sides by additional bends 53 on support plate 5. If necessary, these bends 53 can be additionally provided with taps 20 to grip the monoblock 8 and give it a better hold in support shoe 3.

In accordance with this invention the sole member can be constructed from several self-supporting elastic rubber pieces which are tightened against the support shoe. This mutual layer arrangement of the pieces and their connection with the shoe can be achieved in the forms according to FIGS. 1 and 4 by use of tightening bolts 11. In connection with the design shown in FIGS. 5–7, anchoring of the single elastic grooved pieces is achieved through clamping bolts 15 which extend through each piece and clamp them together into a single unit.

Figure 8:
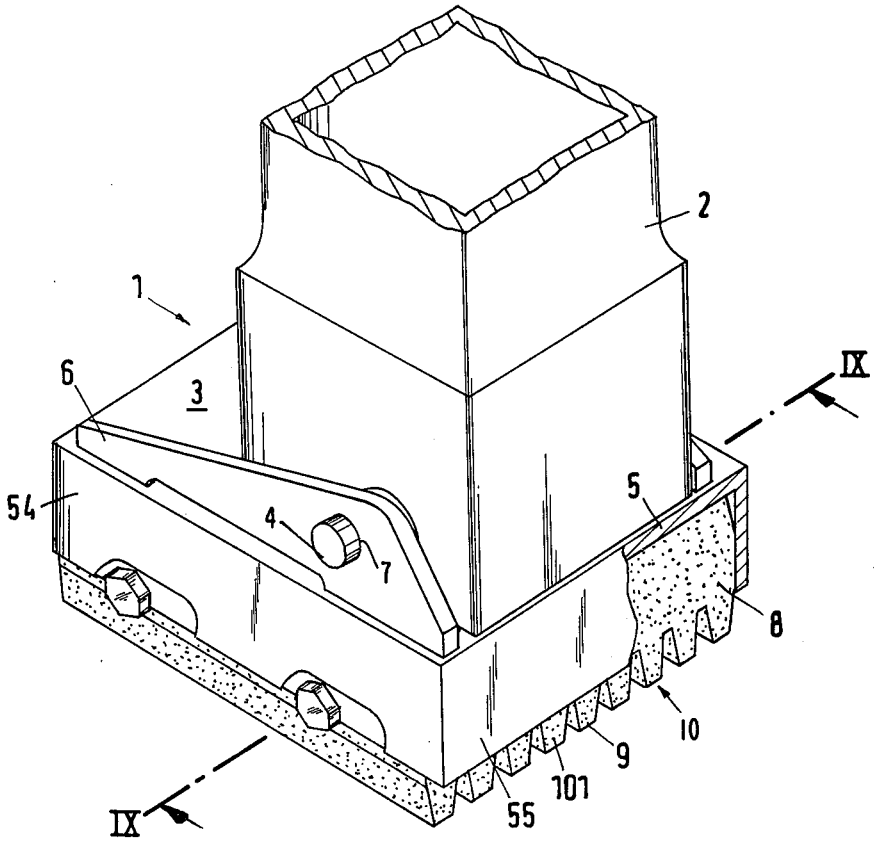
FIG. 8 is a partial, sectional, side, elevational view of another embodiment of the leg support of the present invention.
Figure 9:
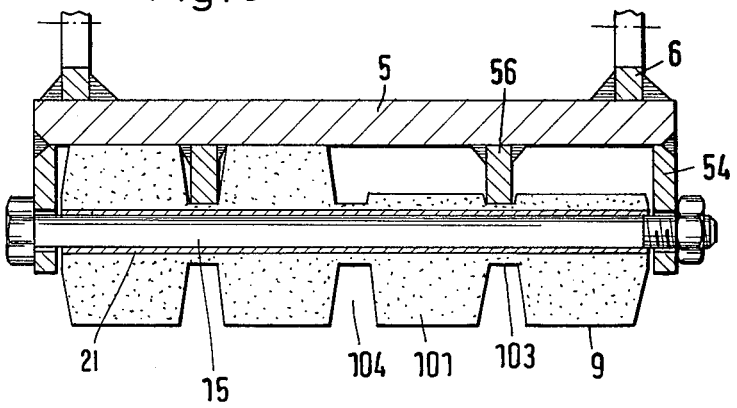
FIG. 9 is a side, sectional view of the leg support of FIG. 8 taken along the lines IX—IX thereof.

Referring to FIGS. 8 and 9, an additional preferred design form of the leg support of the present invention is shown. In this case, the monoblock is fitted as one piece into support shoe 3. The support shoe has at least two welded holding plates 54 and 55 on the opposite edges of support plate 5. The opposing plates 54 can thus be affixed to clamping bolt 15 which runs through the monoblock 8, preferably perpendicular to the tread 101. Monoblock 8 can include steel sleeves 21 for clamping bolt 15. These steel sleeves can be embedded in the monoblock and/or vulcanized thereinto. Support flanges 56 are welded onto the inside of support plate 5, and these flanges 56 interlock into the monoblock 8 between the treads 101, and thus serve to transfer the force to the bottom side 9 of monoblock 8 through support of the inside of the tread 103 to support shoe 3. The cross-section of the support flange 56 is preferably fitted with the cross-section of tread 104. In accordance with this design, as shown in FIG. 9, even after reversal of the monoblock (as shown on the right side of FIG. 9), secure support of the sole is insured without requiring additional support elements under the worn-off surface of the monoblock. Furthermore, monoblock 8 obtains an increased rigidity thereby.

By using a monoblock with a tread according to that shown in FIG. 3, a grid is obtained which is specially suited to the tread made out of support flanges which either cut or are arranged with each other according to the angles of the tread instead of the above described parallel support flanges 56.

The present invention is not intended to be limited by the specific embodiments shown herein, but only by the succeeding claims therefor.

What is claimed is:

1. A leg support for a device subject to vibration and movement, said leg support including a substantially flat lower support shoe, a sole member comprising a single block or elastomeric material and including first and second parallel faces, said first and second faces of said block of elastomeric material being adapted to contact said lower support shoe, and said first and second faces of said block of elastomeric material including substantially uniform treads comprising a plurality of parallel grooves thereacross said grooves including a base portion, whereby upon supporting said device on a surface with said sole member being reversible with either said first or said second face thereof being in contact with said lower support shoe and with said surface, respectively, said sole member may adapt to variations in said surface and to vibrations and movement of said device, support means for detachably maintaining said sole member in a predetermined position in contact with said lower support shoe, said support means comprising at least one pair of parallel side wall members depending from said lower support shoe so as to encompass said sole member between said side wall members, and support flange means projecting from said lower support shoe and having a pattern corresponding to said grooves in said sole member, whereby said support flange means contacts said base portion of said grooves when said sole member is in contact with said lower support shoe.

2. The leg support of claim 1 wherein said elastomeric material comprises rubber.

3. The leg support of claim 1 wherein said support means includes support bolt means including a first end and a second end, said first end of said support bolt means being adjustably affixed to said lower support shoe and said second end of said support bolt means being embedded in said sole member.

4. The leg support of claim 1 wherein said support means includes clamping bolt means extending through said sole member substantially parallel to said lower support shoe, and said clamping bolt means being mounted at its end on said at least one pair of parallel side wall members.

5. The leg support of claim 1 wherein said at least one pair of parallel side wall members comprises and extension of said lower support shoe formed by bends therealong.

6. The leg support of claim 5 wherein said support plates comprises two pairs of said parallel side wall members completely surrounding said sole member.

7. The leg support of claim 1 wherein said support means comprises at least one pair of parallel holding plates welded to said lower support shoe so as to encompass said sole member between said holding plate.

8. The leg support of claim 1 wherein said sole member has a shore hardness of between about 70 and 80.

9. The leg support of claim 1 wherein said substantially uniform treads include a plurality of second parallel grooves across said second face of said sole member substantially perpendicular to said plurality of parallel grooves thereacross.

10. The leg support of claim 1 wherein said substantially uniform treads are formed by a plurality of tread members thereon, said tread members having the cross-sectional shape of a truncated pyramid.

11. The leg support of claim 10 wherein said truncated pyramids include side walls with a slope of between about 6° and 8°.

12. The leg support of claim 1 wherein said parallel grooves have a height of about 25 mm.

13. The leg support of claim 1, wherein said plurality of parallel grooves across said first and second faces of said single block of elastomeric material are parallel to each other.

14. A leg support for a device subject to vibration and movement, said leg support including a substantially flat lower support shoe, a sole member comprising a block of elastomeric material including first and second parallel faces, said first and second faces of said block of elastomeric material being adapted to contact said lower support shoe, and said first and second faces of said block of elastomeric material including substantially uniform treads comprising a plurality of parallel grooves thereacross whereby upon supporting said device on a surface with said sole member being reversible with either said first or said second face thereof being in contact with said lower support shoe and with said surface, respectively, said sole member may adapt to variations in said surface and to vibrations and movement of said device, support means for detachably maintaining said sole member in a predetermined position in contact with said lower support shoe, said support means comprising at least one pair of parallel side wall members depending from said lower support shoe so as to encompass said sole member between said side wall members, and clamping bolt means extending through said sole member substantially parallel to said lower support shoe, said clamping bolt means being mounted at its end on said at least one pair of parallel side wall members, said at least one pair of parallel side wall members adjustably depending from said lower support shoe, whereby the distance between said clamping bolt means and said lower support shoe may be adjusted.

15. The leg support of claim 14 including L-shaped angle means, whereby one leg of said L-shaped angle means comprises said side wall members and said other leg of said L-shaped angle means is parallel and adjacent to said lower support shoe, and screw means for adjustably connecting said other leg of said L-shaped angle means to said lower support shoe.

16. The leg support of claim 14 wherein said sole member comprises a single block of said elastomeric material.

17. The leg support of claim 14 including sleeve means extending through said sole member substantially parallel to said lower support shoe whereby said clamping bolt means may be contained within said sleeve means.

18. The leg support of claim 17 wherein said elastomeric material comprises rubber, and said sleeve means comprises a steel sleeve vulcanized into said sole member.

* * * * *